United States Patent [19]

Jahn

[11] Patent Number: 4,854,231

[45] Date of Patent: Aug. 8, 1989

[54] SHEET-FED ROTARY PRINTING PRESSES FOR MULTI-COLOR PRINTING

[75] Inventor: Hans-Georg Jahn, Wiesenbach, Fed. Rep. of Germany

[73] Assignee: Heidelberger Druckmaschinen Aktiengesellschaft, Heidelberg, Fed. Rep. of Germany

[21] Appl. No.: 177,584

[22] Filed: Apr. 4, 1988

[30] Foreign Application Priority Data

Apr. 14, 1987 [DE] Fed. Rep. of Germany ..... 3712703

[51] Int. Cl.[4] ..... B41F 5/16

[52] U.S. Cl. ..... 101/177; 101/183

[58] Field of Search ..... 101/183, 181, 180, 184, 101/136, 137, 177, 216, 221, 222

[56] References Cited

U.S. PATENT DOCUMENTS

| | | | |
|---|---|---|---|
| 2,207,785 | 7/1940 | Crafts | 101/153 |
| 2,896,535 | 7/1959 | Schünemann | 101/183 X |
| 3,173,360 | 3/1965 | Hamilton | 101/178 |
| 3,173,361 | 3/1965 | Verlik | 101/216 |
| 3,190,218 | 6/1965 | Willard | 101/247 |
| 3,557,692 | 1/1971 | Lee | 101/183 X |
| 3,835,776 | 9/1974 | Weidman | 101/183 |
| 4,000,691 | 1/1977 | Fischer | 101/183 X |
| 4,024,518 | 5/1977 | Boston | 340/206 |
| 4,250,380 | 2/1981 | Iyeta | 250/231 |
| 4,493,255 | 1/1985 | Fischer | 101/183 |
| 4,711,172 | 12/1987 | Capdebosc | 101/183 X |
| 4,732,084 | 3/1988 | Wirz | 101/177 |

FOREIGN PATENT DOCUMENTS

| | | |
|---|---|---|
| 1243210 | 6/1967 | Fed. Rep. of Germany . |
| 2948487 | 12/1979 | Fed. Rep. of Germany . |
| 3413159 | 9/1986 | Fed. Rep. of Germany . |
| 952307 | 1/1963 | United Kingdom . |
| 8704665 | 8/1987 | World Int. Prop. O. . |

*Primary Examiner*—Edgar S. Burr
*Assistant Examiner*—Moshe L. Cohen
*Attorney, Agent, or Firm*—Nils H. Ljungman

[57] ABSTRACT

To make more compact the structure of a sheet-fed rotary printing press and to simplify the installation of the individual printing units, there is provided a separate frame for each printing unit in which the plate cylinder and blanket cylinder are mounted together with the inking and wetting unit. The impression cylinder and the transfer drum are mounted as a transport unit in a fixed base frame. The frames of the printing unit are mounted on the base frame of the transport unit in the longitudinal direction of the press, so that it is possible to create an open space between any two printing units as required by the operator.

21 Claims, 2 Drawing Sheets rails, pneumatic cylinders, locator bolts, and bellows
rotational sensors 1
2
3
4
5
6
7
8
9
10
11
12
13
14
15
16
17
18
19
20
21
22
23
24
25
26
30

SHEET-FED ROTARY PRINTING PRESSES FOR MULTI-COLOR PRINTING

BACKGROUND OF THE INVENTION

1. Field of the Invention:

The present invention relates to a sheet-fed rotary printing press for multi-color printing having printing units arranged in series and including plate cylinders, blanket cylinders and impression cylinders, whereby corresponding to each plate cylinder, there is provided an inking mechanism and a wetting mechanism, and in which the sheets to be printed are transferred through the press between the impression cylinders by means of transfer drums.

2. Description of the Prior Art:

Such sheet-fed printing presses, in themselves, are part of the prior art (for example, German Laid Open Patent Appln. DE-OS No. 29 48 487) and make it possible to print multi-colored sheets. Each printing unit is used to print a specific color, for example, yellow, red, blue or black, so that the number of printing units equals the number of colors to be printed. Between the individual printing units, it is necessary to leave sufficient access for the operator, so that the printing plate, the blanket or even the ink in the inking mechanism can be easily changed. In large format machines, in particular, it is important that the printer have access to the spaces between the presses, in order that the necessary work may be done as easily and as rapidly as possible. These large spaces between the printing units increase the overall length of the machine and can often be created only by providing three transfer drums instead of a single transfer drum between the impression cylinders. This not only increases on the space required for the printing press, but also significantly increases the costs of manufacturing the press. On machines of the prior art, the spaces between the printing units are so narrow that they are not accessible to the operator so that it is very complicated, for example, for the operator to change a plate.

The above-identified German patent publication DE-OS No. 29 48 487 is hereby expressly incorporated by reference as if the entire contents thereof were fully set forth herein.

OBJECT OF THE INVENTION

The object of the present invention is to provide an improved sheet-fed rotary printing press in which a short, compact structure is achieved which takes up a minimum amount of space in the printing plant. Such a structure simplifies the installation of the individual printing units and offers extensive possibilities for variation in the combination of the individual printing units.

SUMMARY OF THE INVENTION

The objects of the invention are achieved in that the impression cylinders and transfer drums are mounted as the transport unit in a fixed base frame, that the plate cylinder and blanket cylinder are mounted with the inking and wetting unit as a printing unit in a frame mounted on the base frame, so that the frames of the printing units are movably mounted on the base frame of the transport unit in the longitudinal direction of the machine, and that the base frame of the transport unit is longer by the width of one printing unit than the width of the frames of the printing units located directly next to one another, so that an open space can be provided by displacement between each two frames of the printing units or at the end of them. The invention makes it is possible, for example, on a four-color press, to save two spaces between printing units so that the total length of the machine can be shortened by the extent of these spaces. Furthermore, with this compact construction, it is possible without additional measures to include a coating or numbering unit, for example, instead of a normal offset inking mechanism. That is, the invention provides the possibility for variation in the composition of the press.

In general, the invention features a printing press for multicolor printing, the printing press comprising: a plurality of printing units arranged in series, each of the printing units comprising a plate cylinder, a blanket cylinder, an inking mechanism and a wetting mechanism; a base frame having a longitudinal dimension and having mounted therein, a plurality of impression cylinders and at least one transfer drum, each of the plurality of printing units being mounted in a printing unit frame; the printing unit frames each having a width, the widths of the printing unit frames being disposed along the longitudinal direction of the base frame: and at least one of the printing unit frames being displaceable along the longitudinal direction of the base frame for providing a space beside at least one of the printing unit frames.

The invention features, in another embodiment, a printing press for multicolor printing, the printing press comprising: a plurality of printing units arranged in series, each of the printing units comprising a plate cylinder, a blanket cylinder and an inking mechanism: a base frame having mounted therein, a plurality of impression cylinders and at least one transfer drum, the base frame having a longitudinal direction; each of the plurality of printing units being mounted in a printing unit frame: the printing unit frames each having a width, the widths of the printing unit frames being disposed along the longitudinal direction of the base frame; and at least one of the printing unit frames being displaceable along the longitudinal direction of the base frame such that each of the printing units may be selectively disposed adjacent more than one of the plurality of impression cylinders for providing a space between at least two of the printing units, the base frame having a length in the longitudinal direction being for providing the space between at least two of the printing units and being at least substantially similar to the width of a printing unit frame.

The invention features, in yet another embodiment, a printing press for multicolor printing, the printing press comprising: a plurality of printing units arranged in series, each of the printing units comprising a plate cylinder, a blanket cylinder, an inking mechanism and a wetting mechanism: a base frame having mounted therein, sequentially along a longitudinal direction of the base frame, a plurality of impression cylinders and at least one transfer drum interposed between the plurality of impression cylinders, a plurality of printing unit frames in which each of the printing units are disposed: and at least one of the printing unit frames having an arrangement for being displaceable along the longitudinal direction of the base frame such that each of the printing units may be selectively disposed adjacent more than one of the plurality of impression cylinders for providing an access space adjacent at least one of the printing unit frames.

BRIEF DESCRIPTION OF THE DRAWINGS

A preferred embodiment of the invention is schematically illustrated in the accompanying drawings, wherein.

DESCRIPTION OF THE PREFERRED EMBODIMENTS

Figure 1:
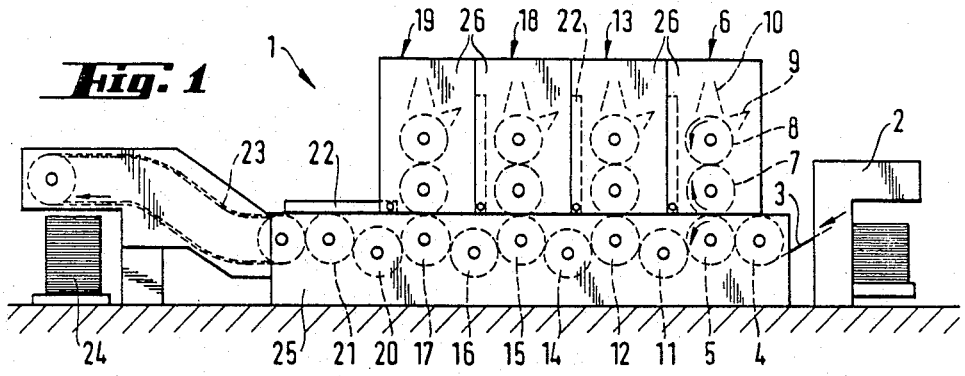
FIG. 1 is an elevational view of a sheet-fed rotary printing press provided with four printing units.

The sheet-fed rotary printing press 1 illustrated in the accompanying drawings has a sheet feeder mechanism 2, which feeds the individual sheets to the printing press by means of a feed table 3. The sheets are then transferred, via a feed drum 4, to a first impression cylinder 5, where they receive their first impression from a corresponding printing unit 6. Printing unit 6 includes, in a known manner, a blanket cylinder 7, a plate cylinder 8, a wetting mechanism 9 and an ink mechanism 10 (well known in the art and shown schematically in the drawings). The printed sheets are then conducted, by means of a transfer drum 11, to a subsequent impression cylinder 12 and there receive a second impression from another printing unit 13, the construction of which is similar to that of printing unit 6. The printed sheet is thereafter transported further by a transfer drum 14, an impression cylinder 15 and a transfer drum 16 to an impression cylinder 17. Impression cylinder 15 corresponds to a third printing unit 18, and impression cylinder 17 to a fourth printing unit 19.

In the described embodiment, therefore, four colors can be printed by means of the four printing units.

According to the invention, the printed sheet is then fed from the fourth impression cylinder 17 via another transfer drum 20 to another impression cylinder 21, both of which are covered with a catwalk 22. This open space allows the operator, for example, to easily change a printing plate mounted on the printing unit 19. The operator is able to comfortably access the available open space.

The catwalk 22 can also serve, in the retracted state of the printing units 6, 13, 18 and 19, as a partition between the printing units, and when configured with a toggle joint, it can automatically be unfolded downward into the accessible position during extension.

From the impression cylinder 21, the finished printed sheets are fed via a feed line 23 to a feed stack 24.

Figure 2:
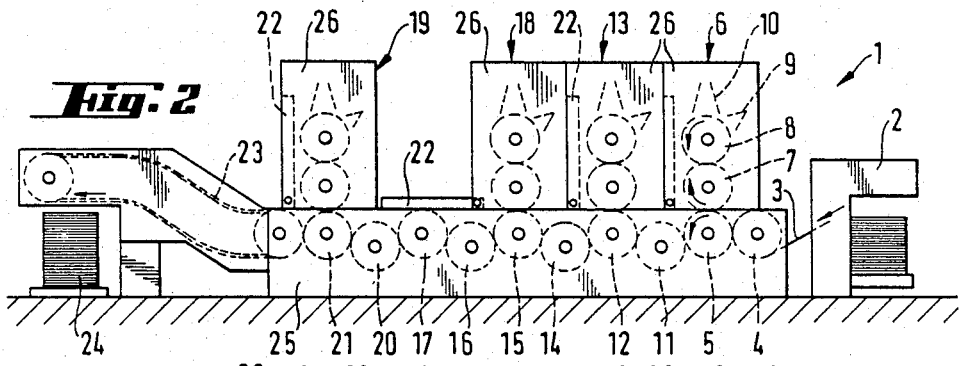
FIG. 2 is likewise an elevational view of the same printing press with one printing unit displaced to the left.

According to the invention, as illustrated in FIG. 2, it now becomes possible to displace the fourth printing unit 19, for example, to the left by the width of one printing unit, so that it works together with the impression cylinder 21. Consequently, there is provided, in such a modified configuration, an open space between the two printing units 18 and 19 to which the operator can have easy access, so that he can perform any necessary work unobstructed.

Figure 3:
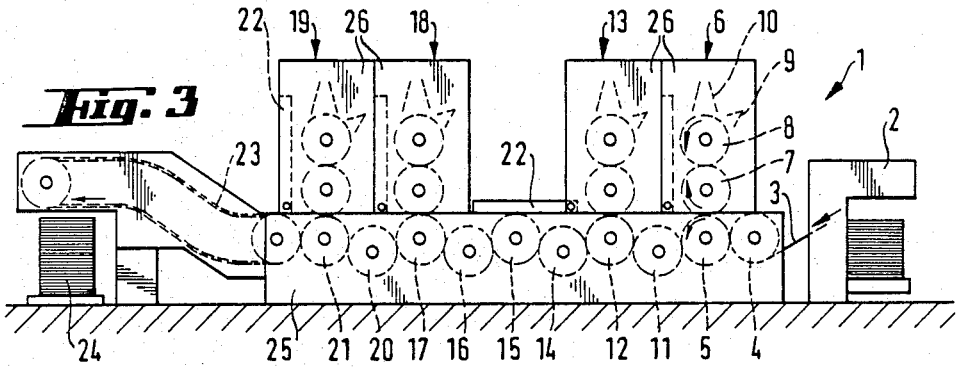
FIG. 3 is likewise an elevational view of the same press with two printing units displaced to the left.
Figure 4:
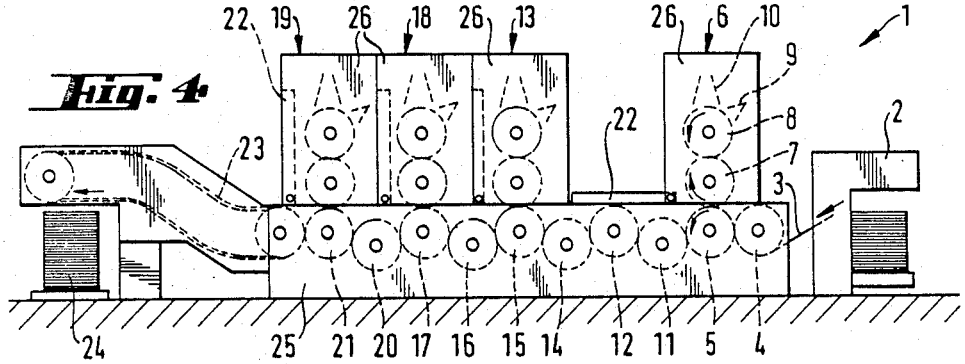
FIG. 4 is likewise an elevational view of the same machine with three printing units displaced to the left.

FIG. 3 illustrates two printing units 18, 19 displaced to the left, so that there is provided an open space between the printing units 13 and 18. FIG. 4 shows three printing units 13, 18, 19 displaced to the left, so that there is provided an open space between the printing units 6 and 13. Depending upon where the operator wishes to perform certain tasks, he can create an open space between the appropriate printing units, so that he can perform the necessary tasks unobstructed. However, a printing press with a total of four printing units can be made shorter, as in the illustrated example, by approximately the width of two open spaces. In addition to the saving in length, other components can also be eliminated (for example, transfer drums with the corresponding drive means), so that a significant cost savings can be achieved.

In a printing press constructed according to the invention, it is, therefore, only necessary to provide a base frame 25, of an appropriate length and relatively torsion proof so that the printing press does not distort and produce deleterious effects during operation, and to provide for the frames 26 of the printing units 6, 13, 18, 19 to be movable on the base frame 25. The frames 26 themselves are preferably reinforced to make easy displacement possible. The same is also true if, for example, the final printing unit in the direction of transport of the sheets is a coating, perforating or numbering mechanism.

Figure 5:
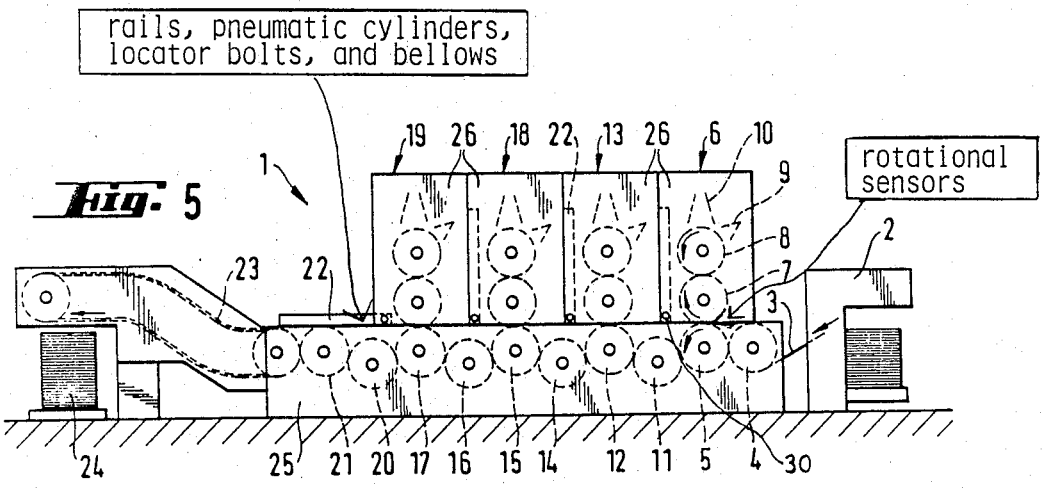
FIG. 5 is similar to FIG. 1, showing additional elements employed in a particularly preferred embodiment of the invention.

In one particular advantageous configuration of the invention, illustrated in FIG. 5, the frames 26 of the printing units 6, 13, 18, 19 are mounted so that they can slide on rails which are fastened to the base frame 25 of the transport unit, whereby pneumatic cylinders can preferably be used to move the transport means. Instead of pneumatic cylinders, other displacement units, for example, chain systems, toothed racks, or similar mechanisms can also be employed. For this purpose, the frames 26 of the printing units 6, 13, 18, 9 may be blocked in their respective printing positions with the base frame 25 of the transport unit for the sheets by means of locator bolts, for example, whereby they are fixed in their precise working position. Other means can also be used for this purpose, such as taper stops and similar devices.

In order to position the drive wheels between the impression and blanket cylinder in a specified position during displacement of the printing units 6, 13, 18, 19, there may be provided electrical position transducers (or "rotational sensors") which monitor the coupling in the correct rotational position. Preferably, the drive wheels of the impression cylinders are located higher than the drive wheels of the transfer drums 11, 14, 16, 20 by at least the height of one tooth. For example, the center point of the impression cylinders may be positioned higher by a slight extent than the center points of the transfer drums in mounted in the base frame 25.

To keep the transmission mechanism free of dirt when displaced to create an open space, the housings can be closed in a simple manner by means of a bellows. This protects the lubricant supply of the displaced frame 26.

The various additional elements of the invention incorporated in the particularly preferred embodiment shown in FIG. 5 are conventional and well known in the art.

For example, the rails which are attached to base frame 25 and upon which printing unit frames 26 are slidingly displaceable may be either flat or profiled rails mounted on both sides of base frame 25 and thereby slidingly engaging the opposing lateral sides of printing unit frames 26.

Pneumatic cylinders are likewise well known and commercially available. Generally, they include a piston and a piston rod which may be displaced by altering the pneumatic pressure existing in the cylinder. In the embodiment of FIG. 5, it has been found to be particularly advantageous to provide at least one such pneumatic cylinder on each side frame.

The locator bolts 30 shown in the embodiment of FIG. 5 are preferably cylindrically ground bolts having a very precise diameter. These bolts are introduced into corresponding holes provided on the side frame and the base frame, such that a precise positioning of the side frame is ensured. Such locator bolts are well known in the art of mechanical engineering.

The rotational sensors employed in the FIG. 5 embodiment are likewise well known in the art and commercially available. They may include, for example, rotational position transducers which monitor the correct circumferential position of the drive wheels to be coupled, thus enabling their precise positioning in either of the plurality of working positions employed. Optical transducers with coded wheels could be used.

Some examples of rotational sensors are found in U.S. Pat. Nos. 4,250,380, entitled "Rotation Angle Detector" and 4,024,518, entitled "Method and Apparatus for Position Referencing the Rotating Drum of a Scanner/-Plotter", both of which are incorporated herein by reference as if the entire contents thereof were fully set forth herein.

As noted above, it is preferred that the drive wheels of the printing cylinders project beyond the drive wheels of the transfer drums by at least the height of one gear tooth. In other words, as shown in FIGS. 1–5, it is preferable that each printing cylinder be mounted somewhat higher than the corresponding transfer cylinder, so that, during longitudinal displacement of printing frames 26 along base frame 25, gear tooth contact between the blanket cylinder and the transfer drum is avoided.

Catwalks (for example, catwalk 22) are additionally well known, and may be provided in the form of a metal grate.

Bellows, such as those employed in the embodiment of FIG. 5 to exclude dirt and other contaminants from the transmission mechanisms, are also well known and commercially available. Generally, they will comprise a pleated plastic or rubber material which may be compressed or extended according to the positioning of the various printing unit frames 26.

Due to the configuration of the individual printing units 6, 13, 18, 19 in separate frames 26 as described, a separate installation of the individual printing units is possible, and these printing units can be tested independently of one another after installation. Therefore, the present invention makes it possible to easily replace individual printing units in the printing plant. Such a replacement can also be made at a later point. In addition, a printing plant with a number of identical presses can keep an inventory of a number of replacement printing units which can be serviced and maintained independently of the presses in operation.

The invention as described hereinabove in the context of the preferred embodiments is not to be taken as limited to all of the provided details thereof, since modifications and variations thereof may be made without departing from the spirit and scope of the invention.

What is claimed is:

1. A printing press for multicolor printing, said printing press comprising:

a plurality of printing units arranged in series, each of said printing units comprising a plate cylinder, a blanket cylinder, an inking mechanism and a wetting mechanism;

a base frame having a longitudinal dimension and having mounted therein a plurality of impression cylinders with a transfer drum between each pair of impression cylinders, said plurality of impression cylinders being greater in number than said plurality of printing units;

each of said plurality of printing units being mounted in a printing unit frame;

said printing unit frames each having a width, said widths of said printing unit frames being disposed along said longitudinal direction of said base frame; and at least one of said printing unit frames being displaceable along said longitudinal direction of said base frame for providing a space beside at least one of said printing unit frames, said space being located above one of said impression cylinders and having a width which is substantially similar to said width of said printing unit frames.

2. The printing press according to claim 1, wherein said printing unit frames have substantially similar widths and said base frame is longer than said plurality of printing unit frames mounted thereon by substantially the width of one printing unit frame.

3. A printing press for multicolor printing, said printing press comprising:

a plurality of printing units arranged in series, each of said printing units comprising a plate cylinder, a blanket cylinder and an inking mechanism;

a base frame having mounted therein a plurality of impression cylinders with a transfer drum between each pair of impression cylinders, said plurality of impression cylinders being greater in number than said plurality of printing units said base frame having a longitudinal direction;

each of said plurality of printing units being mounted in a printing unit frame;

said printing unit frames each having a width, said widths of said printing unit frames being disposed along said longitudinal direction of said base frame; and each of said printing unit frame being displaceable along said longitudinal direction of said base frame such that each of said printing units may be selectively disposed adjacent more than one of said plurality of impression cylinders for providing a space between at least two of said printing units, said base frame having a length in said longitudinal direction for providing said space between at least two of said printing units, said space being located above one of said impression cylinders having a width which is substantially similar to the width of a printing unit frame.

4. A printing press for multicolor printing, said printing press comprising:

a plurality of printing units arranged in series, each of said printing units comprising a plate cylinder, a blanket cylinder, an inking mechanism and a wetting mechanism;

a base frame having mounted therein, sequentially along a longitudinal direction of said base frame, a plurality of impression cylinders with a transfer drum interposed between each pair of said plurality of impression cylinders, said plurality of impression cylinders being greater in number than said plurality of printing units, a plurality of printing unit frames in which each of said printing units are disposed; and each of said printing unit frame having means for being displaceable along said longitudinal direction of said base frame such that each of said printing units may be selectively disposed adjacent more than one of said plurality of impression cylinders for providing an access space adjacent at least one of said printing unit frames, said space being located above one of said impression cylinders and having a width which is approximately equal to the width of said printing units.

5. The printing press according to claim 4, wherein each of said printing unit frames are of substantially equal longitudinal width, as disposed along said longitudinal direction of said base frame, and wherein said length of said base frame in said longitudinal direction is greater by the longitudinal disposed width of one of said printing unit frames, than the combined longitudinal widths of all of said printing unit frames.

6. The printing press according to claim 4, wherein the number of said impression cylinders mounted in said base frame is at least one greater than the number of said printing units displaceable along said longitudinal direction of said base frame.

7. The printing press according to claim 5, wherein the number of said impression cylinders mounted in said base frame is at least one greater than the number of said printing unit frames displaceable along said longitudinal direction of said base frame.

8. The printing press according to claim 4, said printing press further comprising at least one additional unit disposed in a frame being displaceable along said longitudinal direction of said base frame, said additional displaceable frame unit comprising a member chosen from the group consisting essentially of coating means, perforating means and numbering means.

9. The printing press according to claim 5, said printing press further comprising at least one additional unit disposed in a frame being displaceable along said longitudinal direction of said base frame, said additional displaceable frame unit comprising a member chosen from the group consisting essentially of coating means, perforating means and numbering means.

10. The printing press according to claim 6, said printing press further comprising at least one additional unit disposed in a frame being displaceable along said longitudinal direction of said base frame, said additional displaceable frame unit comprising a member chosen from the group consisting essentially of coating means, perforating means and numbering means.

11. The printing press according to claim 4, said printing press further comprising rail means mounted on said base frame, said printing unit frames being slidingly displaceable with respect to said base frame along said rail means, and pneumatic cylinder means for slidingly displacing said printing units with respect to said base frame along said rail means.

12. The printing press according to claim 5, said printing press further comprising rail means mounted on said base frame, said printing unit frames being slidingly displaceable with respect to said base frame along said rail means, and pneumatic cylinder means for slidingly displacing said printing units with respect to said base frame along said rail means.

13. The printing press according to claim 6, said printing press further comprising rail means mounted on said base frame, said printing unit frames being slidingly displaceable with respect to said base frame along said rail means, and pneumatic cylinder means for slidingly displacing said printing units with respect to said base frame along said rail means.

14. The printing press according to claim 4, said printing press further comprising locator bolt means or selectively securing at least one of said printing unit frames at a plurality of locations along said longitudinal direction of said base frame.

15. The printing press according to claim 11, said printing press further comprising locator bolt means for selectively securing at least one of said printing unit frames at a plurality of locations along said longitudinal direction of said base frame.

16. The printing press according to claim 4, wherein said impression cylinders are provided with gear toothed drive wheels, wherein said transfer drums are also provided with gear toothed drive wheels, wherein said impression cylinder drive wheels are located above transfer drum drive wheels by at least the distance of one of said gear teeth.

17. The printing press according to claim 16, comprising rotational position monitoring means for monitoring the rotational positions of said impression cylinders and said blanket cylinders.

18. The printing press according to claim 13, wherein said impression cylinders are provided with gear toothed drive wheels, wherein said transfer drums are also provided with gear toothed drive wheels, wherein said impression cylinder drive wheels are located above transfer drum drive wheels by at least the distance of one of said gear teeth, and further comprising rotational position monitoring means for monitoring the rotational positions of said impression cylinders and said blanket cylinders.

19. The printing press according to claim 4, wherein said printing press further comprises a collapsible catwalk dimensioned to be positioned between adjacent printing units when said adjacent printing units are spaced one from the other, transmission means for driving said impression cylinders and said blanket cylinders and bellows means, said transmission means having means for excluding contaminants from said transmission means.

20. The printing press according to claim 5, wherein said printing press further comprises a collapsible catwalk dimensioned to be positioned between adjacent printing units when said adjacent printing units are spaced one from the other, transmission means for driving said impression cylinders and said blanket cylinders and bellows means, said transmission means having means for excluding contaminants from said transmission means.

21. The printing press according to claim 17, wherein said printing press further comprises a collapsible catwalk dimensioned to be positioned between adjacent printing units when said adjacent printing units are spaced one from the other, transmission means for driving said impression cylinders and said blanket cylinders and bellows means, said transmission means having means for excluding contaminants from said transmission means.

* * * * *